United States Patent [19]

Baumann et al.

[11] 4,049,363

[45] Sept. 20, 1977

[54] AXIAL FLOW FAN WITH ADJUSTABLE BLADES

[75] Inventors: Jan Baumann, Essen-Bredeney; Franz Petter, Herne, both of Germany

[73] Assignee: Gea Luftkuhlergesellschaft Happel GmbH & Co. KG, Bochum, Germany

[21] Appl. No.: 591,062

[22] Filed: June 27, 1975

[30] Foreign Application Priority Data

July 13, 1974 Germany ..... 2433727

[51] Int. Cl.[2] ..... B63H 3/02

[52] U.S. Cl. ..... 416/157 B; 416/162; 416/168 R; 416/246

[58] Field of Search ..... 416/157, 168, 162, 246

[56] References Cited

U.S. PATENT DOCUMENTS

| | | | |
|---|---|---|---|
| 1,310,330 | 7/1919 | Ferrier | 416/162 |
| 2,717,652 | 9/1955 | Nichols | 416/154 |
| 3,085,631 | 4/1963 | Dagrell | 416/168 |
| 3,130,677 | 4/1964 | Liebhart | 416/208 |
| 3,173,343 | 3/1965 | Berry | 416/162 |
| 3,207,226 | 9/1965 | Caldwell | 416/157 |
| 3,228,480 | 1/1966 | Jorgensen | 416/157 |
| 3,229,771 | 1/1966 | Hedberg | 416/157 |
| 3,269,121 | 8/1966 | Bening | 416/157 |
| 3,321,021 | 5/1967 | Girard | 416/159 |
| 3,603,698 | 9/1971 | Jensen | 416/154 |
| 3,637,321 | 1/1972 | Nekrasov et al. | 416/168 |
| 3,700,351 | 10/1972 | Flux | 416/168 |
| 3,711,221 | 1/1973 | Almquist | 416/49 |
| 3,720,387 | 3/1973 | Foote | 416/168 |

FOREIGN PATENT DOCUMENTS

| | | | |
|---|---|---|---|
| 1,189,060 | 9/1959 | France | 416/157 |
| 1,019,046 | 11/1957 | Germany | 416/157 |
| 908,824 | 3/1954 | Germany | 416/157 |

*Primary Examiner*—Everette A. Powell, Jr.
*Assistant Examiner*—Thomas I. Ross
*Attorney, Agent, or Firm*—Michael J. Striker

[57] ABSTRACT

An axial flow fan wherein the cylindrical housings for the shanks of blades are mounted on a flat plate-like circular base of the hub which is rotated by an electric motor through the medium of a belt transmission and a hollow shaft. The motor, transmission and shaft are mounted at one side and the housings are mounted at the other side of the base. The shanks of the blades are turnable simultaneously by a mechanism which has a rod-like pusher extending axially through the base, a double-acting hydraulic or pneumatic cylinder whose piston is rigid with and can move the pusher axially, a displacing disk attached to that end of the pusher which is nearer to the housings, a lever rigidly affixed to each shank, and discrete linkages coupling the disk with each lever so that the levers rotate the respective shanks and blades simultaneously clockwise when the piston moves the pusher axially in one direction and that the levers rotate the respective shanks and blades simultaneously counterclockwise when the piston moves the pusher axially in the other direction. A sleeve on the base supports tie rods which confine the disk to movements in the axial direction of the hub. Alternatively, the sleeve can be omitted and the cylinder can be mounted on the base in a position to support the tie rods. If the cylinder rotates with the hub, the pusher has concentric channels which connect the cylinder chambers with a source of pressurized fluid. The channels can be omitted if the cylinder need not rotate with the hub; the cylinder chambers are then directly connected with the source of pressurized fluid by suitable conduits.

40 Claims, 6 Drawing Figures

AXIAL FLOW FAN WITH ADJUSTABLE BLADES

BACKGROUND OF THE INVENTION

The present invention relates to propeller fans in general, and more particularly to improvements in axial flow fans with adjustable blades.

It is known to provide an axial flow fan with means for changing the angular positions of blades to thereby change the volume of displaced gaseous fluids. As a rule, the shafts or shanks of blades in an axial flow fan are mounted in friction and/or antifriction bearings which are installed in discrete housings. The housings are mounted on a hub which is driven to orbit the blades about its axis. The axes of the blades extend radially or substantially radially of the hub axis. The adjusting means for changing the angular positions of blades comprises devices which can rotate the shanks of blades in the respective housings. A drawback of presently known axial flow fans with adjustable blades is that the adjusting mechanism for the blades is very complex, that the compensation for machining tolerances takes up much time, that the hub for the blades is bulky and comprises a large number of complicated parts, and that the energy requirements for rapid acceleration of the fan to normal operating speed are extremely high.

SUMMARY OF THE INVENTION

An object of the invention is to provide a novel axial flow fan with improved means for changing the angular positions of blades and with an improved hub for the blades.

Another object of the invention is to provide the axial flow fan with a hub which is constructed and assembled in such a way that it affords convenient access to those parts of adjusting means for the blades which are mounted on or close to it, which contributes little to energy requirements of the fan (not only during normal operation but also during acceleration to rated speed), and which can be designed to support a larger or smaller number of housings for the shanks of adjustable blades.

A further object of the invention is to provide an axial flow fan with adjustable blades which is simpler, more compact, less expensive and more versatile than heretofore known axial flow fans.

An additional object of the invention is to provide an axial flow fan with a simple, compact and inexpensive but rugged and reliable adjusting mechanism for the fan blades which can be readily adjusted upon completed assembly of the fan to compensate for eventual machining tolerances and which insures uniform adjustment of all blades, even after long periods of use.

The improved axial flow fan comprises a hub which is rotatable about a first axis and includes a substantially circular plate-like base having a preferably smooth and flat first side normal to the first axis, an electric motor or analogous means for rotating the base (preferably through the medium of a suitable transmission and a shaft which is affixed to the second side of the base), a plurality of preferably cylindrical hollow housings affixed to the base at the first side of the base and each having an axis which is normal to the first axis, a plurality of blades, one for each housing and each having a shank journalled in the respective housing and being turnable about the respective second axis, and adjusting means for turning the shanks and the blades. The adjusting or turning means comprises an elongated rod-like pusher whose axis coincides with the first axis and which extends through the base, means (preferably including a fluid-operated motor) for moving the pusher axially, a disk or other suitable displacing means affixed to the pusher at the first side of the base and being rotatable with the hub, a lever rigid with each shank, and a discrete power train (preferably a linkage) connecting each lever with the displacing means so that axial movements of the pusher (and hence of the displacing means) in first and second directions respectively result in simultaneous clockwise and counterclockwise angular displacements of the shanks and associated blades.

The shanks are rotatable in friction and/or antifriction bearings which are mounted in the respective housings and each shank is held against movement in the axial direction of the respective housing, (e.g., by the corresponding bearing(s) and/or by other suitable means). The blades are affixed to those end portions of the shanks which are remote from the first axis, and the levers are preferably removably affixed to those end portions of the shanks which are nearer to the first axis. The housings for the shanks of the blades are equally spaced from each other, as considered in the circumferential direction of the base. The second side of the base is preferably smooth and flat and is adjacent to the means for rotating the hub. The components of each power train are articulately connected to each other, to the displacing means and to the respective levers, preferably with minimal play. The fan preferably further comprises guide means for the displacing means; such guide means may be mounted on a sleeve which forms part of the hub, which is rigid and coaxial with the base, and which is located at the first side of the base. The purpose of the guide means is to confine the displacing means to movements in the direction of the first axis; such guide means may comprise one or more elongated tie rods and followers which are adjustably mounted in the displacing means and may resemble sleeves which surround and are slidable along the respective tie rods.

The novel features which are considered as characteristic of the invention are set forth in particular in the appended claims. The improved axial flow fan itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
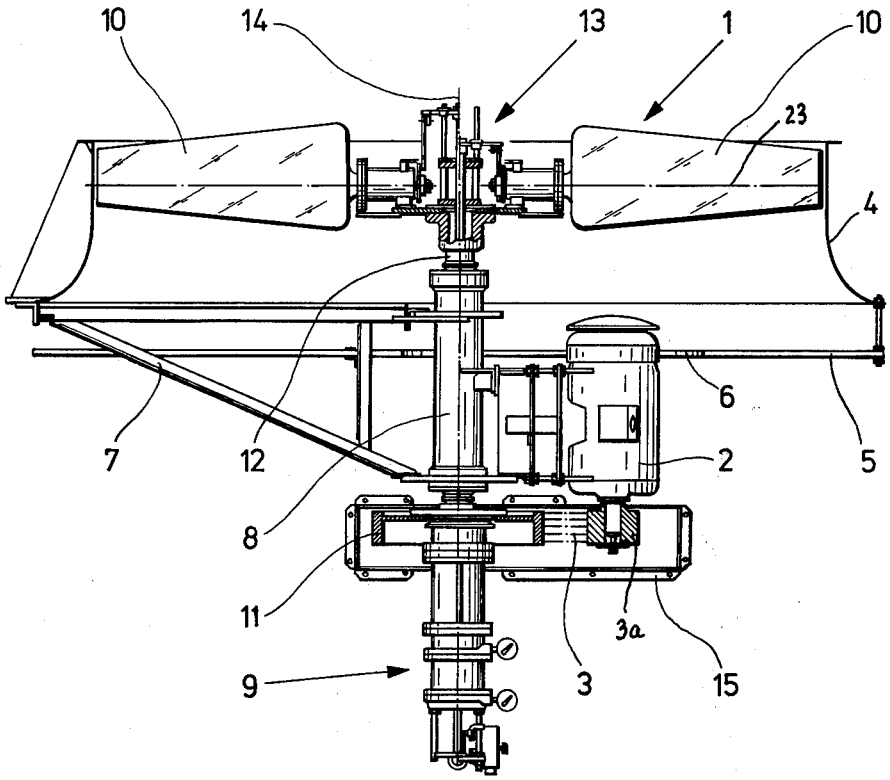
FIG. 1 is a fragmentary partly elevational and partly axial sectional view of an axial flow fan with adjustable blades which embodies one form of the invention.

Referring first to FIGS. 1 to 4, there is shown an axial flow fan 1 with adjustable or turnable blades 10. The means for orbiting the blades about an axis 14 comprises an electric motor 2 whose output element drives a first pulley 3*a* of a V-belt transmission 3. The second pulley 11 of the transmission 3 drives a hollow shaft 12 which, in turn, rotates a hub 13 which carries the blades 10. The blades 10 are surrounded by a stationary ring-shaped case 4 which is connected with a protective screen 5 disposed between the blades 10 and hub 13 on the one hand and the belt transmission 3 on the other hand. A relatively small opening 6 in the screen 5 permits a portion of the motor 2 to extend beyond the upper side of the screen, as viewed in FIG. 1. The opening 6 can be omitted if the orbiting means for the blades 10 employs a smaller motor or a motor which is mounted at a level below that of the motor 2 shown in FIG. 1. The fan 1 further comprises a stationary bearing sleeve or support 8 to which the screen 5 is conected by means of three equally spaced props 7.

The hollow shaft 12 for the hub 13 extends through the support 8. A protective basket 15 surrounds the belt transmission 3 from below; this basket is secured to another stationary part of the fan. The latter further comprises an adjusting or turning mechanism 9 which can turn the blades 10 about their respective axes 23, namely about axes which are normal to and intersect the common axis 14 of the pulley 11, hollow shaft 12 and hub 13. A portion of the adjusting or turning mechanism 9 is mounted below the support 8, as viewed in FIG. 1 or 4; this portion comprises rotary pneumatic cylinder and piston means whose axis coincides with the axis 14. It is clear that the cylinder and piston means of the adjusting mechanism 9 can be operated with oil or another hydraulic fluid. The actuation of cylinder and piston means reslts in turning of all blades 10 about the respective axes through angles of identical magnitude and in the same direction; consequently, and since the cylinder and piston means are accessible below the protective basket 15, as viewed in FIG. 1 or 4, the adjustment of blades 10 can be effected while the fan is in actual use.

Figure 2:
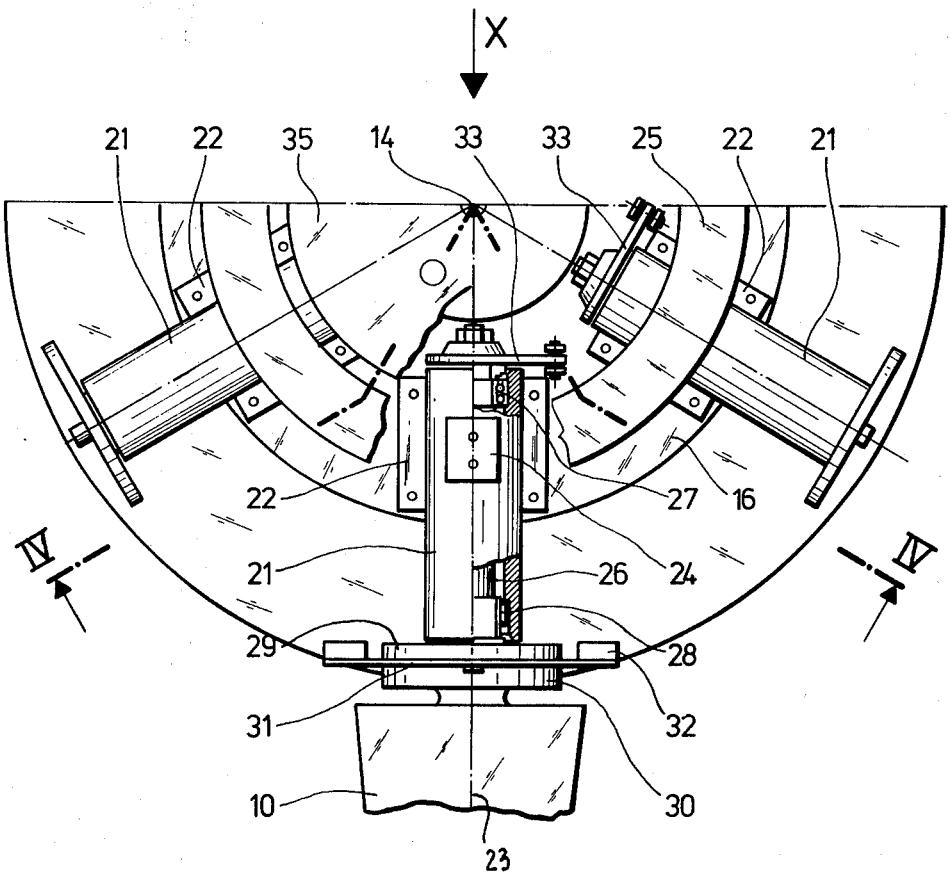
FIG. 2 is an enlarged fragmentary plan view of the fan, with the housing for the shank of one of the blades shown in partial section.
Figure 3:
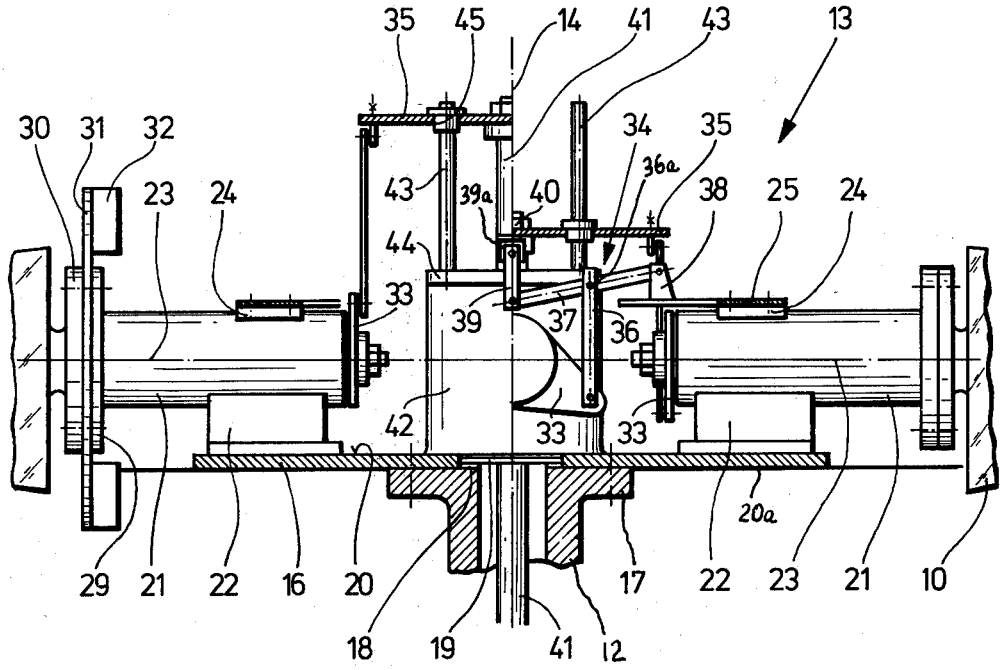
FIG. 3 is an enlarged axial sectional view of a detail of the fan in the region of connections between the adjusting mechanism and the shanks of the fan blades, substantially as seen in the direction of arrow X in FIG. 2, one of the shanks being shown in a first and another of the shanks being shown in a second end position turned through 90 degrees with respect to the one shank.

The details of construction of the hub 13 for the blades 10 are shown in FIGS. 2 and 3. In FIG. 3, the adjusting unit for the right-hand blade 10 maintains this blade in one end position and the adjusting unit for the left-hand blade maintains this blade in the other end position; however, and as mentioned above, the blades are turned simultaneously, in the same direction and through angles of identical magnitude. A sleeve 42 of the hub 13 is shown in section in the right-hand portion and in elevation in the left-hand portion of FIG. 3.

The hub 13 further comprises a circular plate or base 16 having two substantially flat and smooth sides or surfaces one of which (shown at 20) faces toward the blades 10 and the other of which (shown at 20*a*) faces toward the screen 5. The base 16 is bolted or otherwise fixedly secured to and receives torque from a flange 17 at the adjacent end of the shaft 12. The flange 17 has an annular centering extension 18 which projects into a centrally located opening 19 of the base 16. The base 16 supports six discrete housings 21, one for each blade 10. The housings 21 are hollow and elongated and extend radially outwardly from the sleeve 42 of the hub 13. The axes 23 of two neighboring blades 10 make an angle of 60°. It is clear that the improved fan may comprise fewer or more than six blades. The housings 21 are secured to the base 16 by discrete brackets 22 which are adjacent to the periphery of the base and are secured thereto by means of bolts or screws. Each bracket 22 is preferably welded to the respective housing 21. The illustrated housings 21 are smooth-surfaced cylinders which can be produced from profiled tubular stock. If the axial flow fan is convertible, i.e., if it can be used with smaller or larger blades, it will be furnished with several types of housings 21 having different diameters and/or lengths and, if necessary, with two or more plates or bases 16 having different diameters and/or thicknesses. The stability of the hub 13 is enhanced by the provision of substantially T-shaped stiffening or reinforcing elements 24 which are disposed diametrically opposite the brackets 22 (with reference to the respective axes 23). Each reinforcing element 24 is fixedly secured to the respective housing 21 and to a flat ring-shaped holder 25 whose center is located on the axis 14 and whose plane is parallel to the plane of the base 16. Each reinforcing element 24 may be screwed or bolted to the holder 25. The width of the holder 25, as considered in a direction radially of the sleeve 42, equals or approximates the length of a reinforcing element 24.

The shafts or shanks 26 of the blades 10 are journalled in the respective housings 21 in a manner shown in FIG. 2. That end portion of a shank 26 which is remote from the respective blade 10 is rotatable in a double-row angular-contact ball bearing 27 and the other end portion of the shank 26 rotates in a needle bearing 28. The bearings 27 (or other suitable means) hold the shanks 26 against movement of the direction of the respective axes 23. The bearings 27, 28 are installed in the respective housings 21. Those ends of the shanks 26 which extend outwardly beyond the respective housings 21 are formed with flanges 29 which are bolted or screwed to flanges 30 of the respective blades 10 so that each blade shares all angular movements of the respective shank 26 in the associated housing 21. If desired or necessary, each shank 26 may support a plate-like carrier 31 for adjustable and removable balancing weights 32. The carriers 31 may be clamped between the flanges 29, 30 and the weights 32 may be adjustable radially and/or circumferentially of the respective carriers Each weight 32 may be composed of two or more separable sections so that its mass may be changed by adding or removing one or more sections. The sections of a weight 32 may but need not have the same mass and/or shape.

The inner ends of the shanks 26 (i.e., those ends which extend beyond the respective housings 21 toward the axis 14) are rigidly but separably connected with flat levers 33 located in planes which are parallel to the axis 14. The free end of each lever 33 is articulately connected to one terminal point of a power train shown in FIG. 3 as a linkage 34 the other terminal point of which is articulately connected with a flat displacing disk 35 concentric with the holder 25. The details of one of the six power trains or linkages 34 are shown in the right-hand portion of FIG. 3. The displacing disk 35 is rotatable with the base 16 and is movable toward and away from the base to thereby change the angular positions of the blades 10 through the medium of the respective linkages 34, levers 33 and shanks 26. Each linkage 34 is located in a plane which is parallel to the axis 14 and comprises a double link 36 one end of which is pivotally connected with the respective lever 33 and the other end of which carries a fulcrum 36*a* for a two-armed intermediate lever 37. The outer arm of the lever 37 is pivoted to a bearing block 38 mounted at the upper side of the holder 25, and the inner arm of the lever 37 is pivoted to one end of a double link 39. The other end of the link 39 is pivotably secured to a bearing block 39*a* which is affixed to the disk 35 by screws 40 or analogous fastener means. Each link 39 is pivotable about an axis which is normal to the axis 14. The screws 40 constitute an adjustable connection between the double link 39 and the disk 35 so that the linkage 34 may be adjusted in order to compensate for possible manufacturing tolerances and to thus insure that each of the six blades 10 will be rotated to the same extent in response to movement of the displacing disk 35 toward or away from the upper side 20 of the base 16. The underside of the disk 35 may be provided with or connected to radially extending stiffening ribs. The pivotal connections between the levers 33 and the respective linkages 34, between the linkages 34 and the respective blocks 39*a,* as well as between the components of each linkage 34 preferably include self-lubricating or sealed friction or antifriction bearings, preferably needle bearings. Friction bearings can be used with advantage in relatively small axial flow fans. The bearings insure that the play between neighboring parts which are movable relative to each other is negligible which, in turn, insures a highly reproducible adjustment of all blades, even after extended periods of use.

Figure 4:
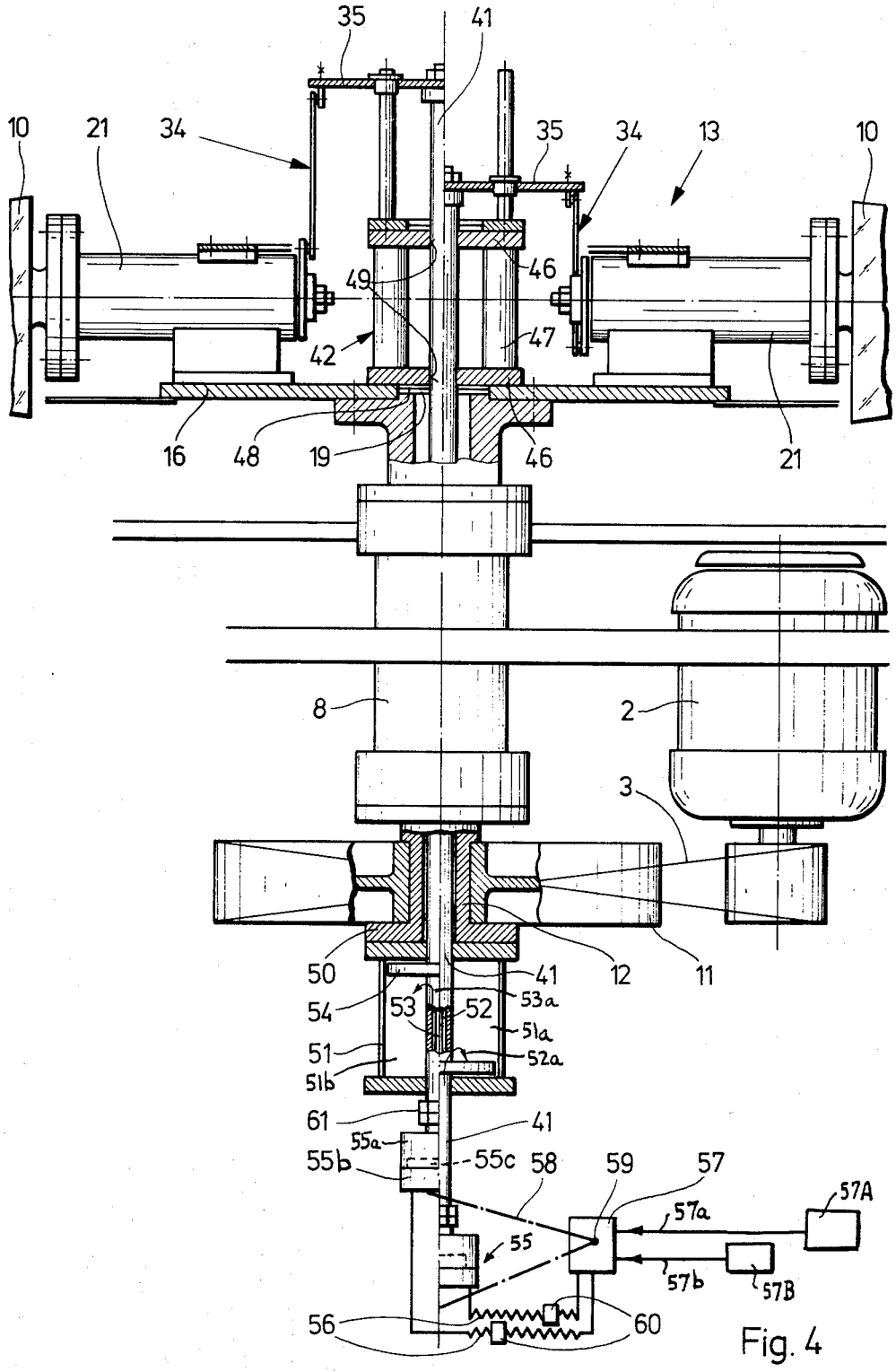
FIG. 4 is a sectional view of the fan as seen in the direction of arrows from the line IV—IV of FIG. 2, one of the shanks being shown in the first and another shank being shown in the second end position.

The levers 33, linkages 34 and displacing disk 35 constitute component parts of the adjusting mechanism 9 which further comprises the aforementioned cylinder and piston means adjacent to the protective basket 15 as well as means for transmitting motion from the cylinder and piston means to disk 35. The motion transmitting means comprises a rod-like pusher 41 which is coaxial with and extends through the support 8, the hollow shaft 12 of orbiting means for the blades 10, and the sleeve 42 of the hub 13. The axis of the pusher 41 coincides with the axis 14. The upper end portion of the pusher 41, as viewed in FIG. 1, 3 or 4, is fixedly secured to the displacing disk 35 so that the disk 35 moves toward or away from the base 16 in response to axial movements of the pusher. The guide means for the disk 35 comprises two tie rods 43 which are disposed diametrically opposite each other with reference to the axis 14 and are secured to a plate 44 at the top of the sleeve 42. The tie rods 43 extend in parallelism with the pusher 41 and guide (with minimal clearance) sleeve-like followers 45 installed in the disk 35. Each follower 45 is preferably adjustable with respect to the disk 35 to enable a mechanic to prevent jamming of the disk 35 due to machining tolerances.

As shown in FIG. 4, the sleeve 42 of the hub 13 may comprise two coaxial flat ring-shaped members 46 which are secured to each other by distancing members 47 and one of which is secured to the base 16. The lower member 46, as viewed in FIG. 4, is preferably formed with a centering projection 48 extending without any or with minimal play into the central opening 19 of the base 16. The members 46 of the sleeve 42 have centrally located openings 49 bounded by cylindrical guide surfaces for the pusher 41.

The pulley 11 of the belt transmission 3 is mounted close to the lower end of the hollow shaft 12, as viewed in FIG. 1 or 4, i.e., the pusher 41 extends downwardly beyond the pulley 11. The lower end portion of the shaft 12 has a ring-shaped flange 50 located below the pulley 11 and affixed to a double-acting cylinder 51 of the adjusting mechanism 9. The pusher 41 extends centrally through the cylinder 51 and is rigid with a piston 54 which is reciprocable in the interior of the cylinder. The lower end portion of the pusher 41 (which can be said to constitute the piston rod of the piston 54) has an axial fluid-conveying channel or bore 52 receiving with clearance a pipe 53 having a second channel or bore. The pusher 41 is further formed with a first port 52*a* (indicated by an arrow) which admits pressurized fluid into the upper chamber 51*a* of the cylinder 51 when the bore 52 receives pressurized fluid from a suitable source. Still further, the pusher 41 has a second port indicated by our arrow 53*a* which communicates with the tube 53 and with the lower chamber 51*b* of the cylinder 51. The ports 52*a,* 53*a* are located at different levels and diametrically opposite each other with respect to the axis 14. The lowermost part of the pusher 41 extends downwardly beyond the cylinder 51 and is connected with the source of pressurized fluid by way of a composite connector 55 having a rotary portion 55*a* and a non-rotatable portion 55*b.* The latter is held against rotation by suitable blocking means and is connected to a control device 57 by way of flexible hoses 56. The portion 55*b* is further articulately connected with a lever 58 which is mounted on the shaft 59 of the control device 57 and whose angular position is indicative of the axial position of piston 54 and pusher 41, i.e., of the angular positions of blades 10. The length of the lever 58 is preferably adjustable and/or the control device 57 is movable toward or away from the axis 14 to thus change the maximum extent of lengthwise movement of the pusher 41, i.e., the maximum extent of angular movement of blades 10 about the respective axes 23 in either direction. By shifting the control device 57 radially of the axis 14 (whereby the lever 58 turns about the axis of the shaft 59), one can pivot the lever 58 to thereby change the axial position of the pusher 41 and the angular positions of blades 10 when the fluid-operated portion of the adjusting mechanism 9 is defective or out of commission for another reason. The control device 57 can be adjusted relative to the cylinder 51 by pivoting it about the shaft 59, i.e., about an axis which is normal to and crosses in space with the axis 14.

Two hoses or conduits 56 contain diaphragm valves 60 which seal the source of pressurized fluid from the respective chambers 51*a,* 51*b* when the pressure of working fluid against their diaphragms is below a preselected value.

Nuts 61 between the connector 55 and cylinder 51 are adjustable axially of the shaft 12 to determine the maximum possible angular adjustment of blades 10.

The control device 57 does not rotate with the cylinder 51 and shaft 12; it is preferably held against rotation by suitable blocking means, e.g., by the blocking means which prevents rotation of portion 55*b* of the connector 55. The operation of the adjusting mechanism is preferably such that the angle of inclination of blades 10 is reduced in response to movement of the pusher 41 in a direction to advance the displacing disk 35 toward the base 16 (see the right-hand portion of FIG. 4) If the angle of the blades 10 is to be increased, the port 53*a* admits pressurized fluid from the corresponding conduit 56 and from pipe 53 into the cylinder chamber 51*b* whereby the piston 54 moves the pusher 41 upwardly and the displacing disk 35 is caused to move away from the base 16 of the hub 13. Such movement of the disk 35 results in transmission of pure tensional stresses (pull) to the linkages 34. If the cylinder 51 is large enough, the carriers 31 and weights 32 can be dispensed with. The parts below the basket 15 are fully accessible so that their inspection, adjustment and/or repair is a simple procedure which takes up little time. In fact, at least some of these operations (e.g., adjustment) can be carried out while the fan is in use.

An advantage of the double-acting cylinder 51 is that it need not contain or cooperate with springs or analogous resilient means which are used in certain types of fans to effect adjustments of blades in one direction. Such springs invariably possess at least some hysteresis. The control device 57 contributes to accurate adjustment of all blades 10 with a minimum of friction and in such a way that the accuracy of adjustment is not influenced by the weight of the control device. The latter is preferably designed to insure that, when certain pneumatic or hydraulic components of the adjusting mechanism 9 are out of commission, the blades 10 can be moved to neutral position (no displacement or fluid) or to a position of maximum displacement. Moreover, the adjusting means 9 can be designed to insure at least temporary operation of the fan with the blades 10 in angular positions in which they were held prior to breakdown of the hydraulic or pneumatic system. The diaphragm valves 60 in the conduits 56 contribute to such operation of the fan.

That portion of the pusher 41 which extends above the base 16 is not subjected to any bending or flexing stresses. If such stresses exist, the followers 45 are adjusted relative to the displacing disk 35 and/or the mass and/or positions of the weights 32 are changed with respect to the corresponding carriers 31. Thus, the pusher 41 merely transmits axial stresses by moving up or down, together with the piston 54. The components of linkages 34 are subjected only to tensional stresses. As a rule, the weights 32 can be dispensed with because the hub 13 and all parts mounted thereon are perfectly balanced. Eventual minor unbalances can be counteracted by using a cylinder 51 which can furnish the necessary force to move the pusher 41 through increments of desired length.

The control device 57 is available on the market as self-contained unit. Referring again to FIG. 4, this control device can be connected with a source 57A of pressurized working fluid by a conduit 57*a,* and with a source 57B of pressurized control fluid by a conduit 57*b.* For example, the source 57B can contain compressed air at a constant pressure of say 3 atmospheres superatomospheric pressure. The pressure of control fluid which is supplied by conduit 57*b* can vary, e.g., between 0.2–1 atmosphere superatmospheric pressure. Each pressure of control fluid in the conduit 57*b* corresponds to a different axial position of the piston 54 in the cylinder 51 and hence to a different angular position of the blades 10.

For example, if the blades 10 are to be moved from zero position (no displacement of air) corresponding to the lower end position of the piston 54, as viewed in FIG. 4, to an intermediate position, this necessitates a certain axial displacement of piston 54 in a directin toward the base 16. It is now assumed that the piston 54 is to be moved to an intermediate position by raising the pressure of control fluid in the conduit 57*b* from 0.2 to 0.6 atmosphere superatmospheric pressure. The control device 57 then admits working fluid (at 3 atmospheres superatmoshperic pressure) into that conduit 56 which communicates with the port 53*a* so that such working fluid flows into the cylinder chamber 51*b* and the piston 54 moves upwardly. When the piston 54 reaches the desired position, such position is indicated to the control device 57 by the lever 58 which pivots in response to axial displacement of the pusher 51 with the piston 54. The control device 57 then seals the conduit 57*a* from the port 53*a.* If the piston 54 has the tendency to move back and forth before it reaches the desired axial position, the control device 57 alternatively admits pressurized working fluid to the chambers 51*a,* 51*b* until the lever 58 begins to indicate that the piston 54 dwells in the selected position. In other words, the control device 57 is capable of moving the piston up or down, depending on the angular position of the indicating lever 58, as long as it is necessary to insure that the pusher 41 actually reaches and remains in the desired axial position.

The control device 57 is preferably further designed to automatically move the piston 54 to the upper or lower end position. Thus, and if the source 57B does not contain any control fluid, the control device 57 can be designed to automatically admit working fluid from conduit 57*a* into the port 53*a* or 52*a,* depending upon whether it is desired that the pusher 41 should assume its lower or upper end position whenever the control device 57 is incapable of selecting therefor any one of a practically unlimited number of intermediate positions.

The diaphragm valves 60 in the conduits 56 insure that the pusher 41 temporarily remains in a previously selected position if the supply of control fluid in the source 57B is exhausted for a relatively short interval of time. This renders it possible to operate the fan 1 with the previously selected adjustment of blades 10 until the supply of control fluid in the source 57B is restored, provided that the malfunction can be eliminated within that interval of time during which the valves 60 are capable of holding the pusher 41 in the previously selected position.

The parts 57*a,* 56, 55 together constitutes a composite conduit which connects the source 57A with the chambers 51*a,* 51*b* and wherein the flow of working fluid is controlled by the device 57.

An important advantage of the improved axial flow fan is that it utilizes an extremely simple, compact, lightweight and inexpensive hub. Thus, the basic component part of the hub 13 is a simple circular plate-like base 16 whose major sides or surfaces 20, 20*a* are preferably smooth, flat and parallel to each other. This base may be mass-produced from sheet metal by restoring to conventional machinery, and further machining of the base is an equally simple procedure, i.e., the base must be formed with tapped or untapped holes or bores for fasteners which secure the housings 21 to its side 20. If the holes are not tapped, they can be machined (e.g., stamped) during the making of the base, e.g., during stamping from a metal sheet. As mentioned above, a base 16 having a given diameter can support a relatively large or a relatively small (even or odd) number of housings 21, and such base (particularly if properly dimensioned and reinforced) can support a selected number of smaller- or larger-diameter or shorter or longer housings 21. If the axial flow fan is to be converted into one for displacement of larger or smaller volumes of air or another gaseous fluid, it can be furnished with two or more bases 16 each of which is designed to support a predetermined number of housings 21 having a given diameter and/or length. The manufacturing cost of the fan is increased only negligibly if the fan is furnished with one or more spare bases 16 since the cost of a base is extremely low. However, it will suffice (in many instances) to provide the base 16 with a relatively large number of holes for fasteners so that the number of housings 21 can be reduced or increased, if and when necessary. The addition or removal of one or more housings 21, or the replacement of a base 16 with a larger or smaller base takes up little time so that such replacement necessitates only short-lasting interruptions in operation of the axial flow fan. As a rule, one or two spare bases 16 will suffice to enable the fan to operate satisfactorily under any foreseeable set of circumstances.

The mass of the base 16, plus the mass of housings 21 thereon, is small because such parts are of simple and preferably lightweight construction. Therefore, the starting moment of the fan is small and, consequently, the energy requirements for rapid acceleration of blades to rated speed are surprisingly low. The base 16 and/or the holes or bores therein can be designed with a view to properly balance the hub 13; however, the balancing is a rather simple procedure anyway since the base 16 is of circular shape and also because the housings 21 are equally spaced from each other, as considered in the circumferential direction of the hub. The weight or mass of all housings 21 is preferably identical; this also reduces the likelihood of unbalance.

Another important advantage of the improved hub 13 is that it affords convenient access to all or nearly all component parts at the upper side 20 or at the underside 20*a* of the base 16. This reduces the costs for repair and/or adjustment, e.g., to eliminate eventual play between the component parts of linkages 34 and/or between the linkages 34 and parts which are articulately connected therewith, to properly adjust the followers 45, to change the positions and/or mass of weights 32 on their carriers 31, to increase or reduce the number of housings 21, and/or to replace the housings 21 with housings having different diameters and/or length. The absence of dead corners or closed compartments reduces the likelihood of accumulation of water and/or dust; such foreign matter could contribute to unbalance of the hub 13 during rotation. In order to reduce the likelihood of corrosion, some or all exposed surfaces of component parts of the fan can be hot galvanized or otherwise treated to withstand the corrosive effect of surrounding atmosphere. The smaller hardware, such as screws, bolts, pivot pins and the like, are preferably made of stainless steel to insure long useful life, to reduce the likelihood of jamming and to contribute to a higher degree of accuracy and uniformity in angular adjustment of the blades.

Figure 5:
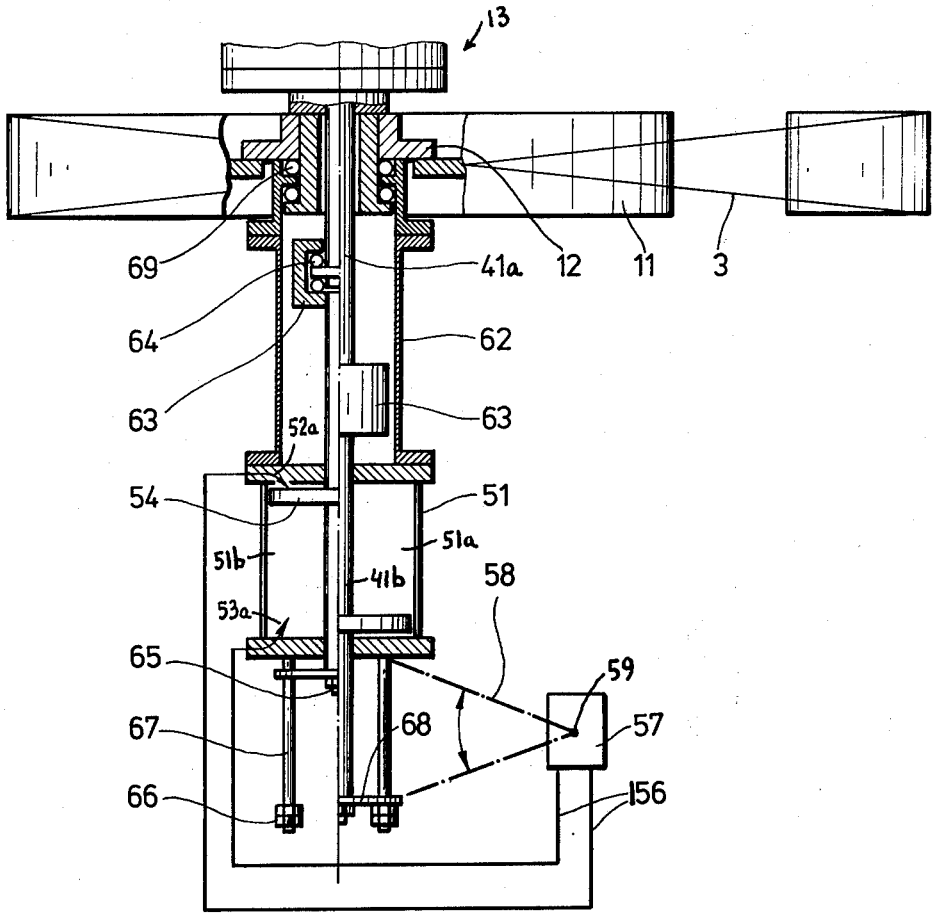
FIG. 5 is a fragmentary sectional view similar to that of FIG. 4 but showing a modified axial flow fan.

FIG. 5 shows a portion of a second axial flow fan wherein the hub 13 is identical with that of the fan 1. The double-acting cylinder 51 is bolted or otherwise affixed to a casing 62 and does not rotate with the hub. The means for blocking rotation of the cylinder 51 may include the casing 62 along and/or other suitable blocking means. The casing 62 surrounds a coupling element 63 mounted on a double-row angular contact antifriction bearing 64 and enabling the upper portion 41*a* of the pusher 41 to rotate about the axis 14 relative to the piston 63; however, the latter shares all axial movements of the pusher without any or with minimal play. The element 63 couples the lower portion 41*b* of the pusher to the upper portion 41*a* in such a way that the portions 41*a*, 41*b* move as a unit up or down, as viewed in FIG. 5, but the lower portion 41*b* need not share any angular movements of the portion 41*a*. The lower portion 41*b* extends through the cylinder 51 and is rigid with the piston 54.

Since the cylinder 51 does not rotate, the lower portion 41*b* of the pusher 41 need not be provided with channels, i.e., it does not contain a pipe 53 as in the embodiment of FIGS. 1 to 4. The admission of pressurized fluid into the chamber 51*a* or 51*b* of the cylinder 51 takes place via stationary conduits 156 one of which is in communication with a port 52*a* and the other of which is in communication with a port 53*a* of the cylinder (both ports are indicated by arrows). The conduits 156 are connected with the control device 57 whose shaft 59 is connected with a lever 58 serving as a means for indicating the axial position of pusher 41*a*, 41*b* and hence the angular positions of blades (not shown). The maximum extent of axial displacement of the pusher 41*a*, 41*b* is determined by the axial position of a nut 65 which is threadedly connected with the lower end of the portion 41*b* below the cylinder 51 and by additional nuts 66 meshing with the lower end portions of elongated guide rods 67 for a cross-head 68 which is affixed to the portion 41*b* above the nut 65 and is slidable (with minimal or without any clearance) along the rods 67. The lever 58 is articulately connected with the cross-head 68. The mode of operation of the control device 57 in identical with that of the control device shown in FIG. 4.

The upper end portion of the casing 62 is coupled to the lower end portion of the hollow shaft 12 by an anti-friction bearing 69. In order to insure that a single double-acting cylinder 51 can be used irrespective of the number of blades and irrespective of the size of the base 16 (not shown) and housings 21 (not shown), the fan which embodies the structure of FIG. 5 is preferably equipped with adjustable counterweights. Also, and since the forces to be applied to the shanks of the blades are transmitted to the parts of adjusting mechanism on the hub 13 via hollow shaft 12, bearings for the moving parts of adjusting mechanism below the casing 62 and bearings for moving parts of the control device 57, the extent of axial movement of pusher 41 and the just mentioned forces cannot be increased at will. The counterweights insure that the magnitude of the forces necessary for adjustment of blades does not vary within a wide range even if one and the same cylinder 51 is used irrespective of the number and size of housings for the shanks of blades and/or irrespective of the diameter and mass of the base in the hub 13 of the fan.

Figure 6:
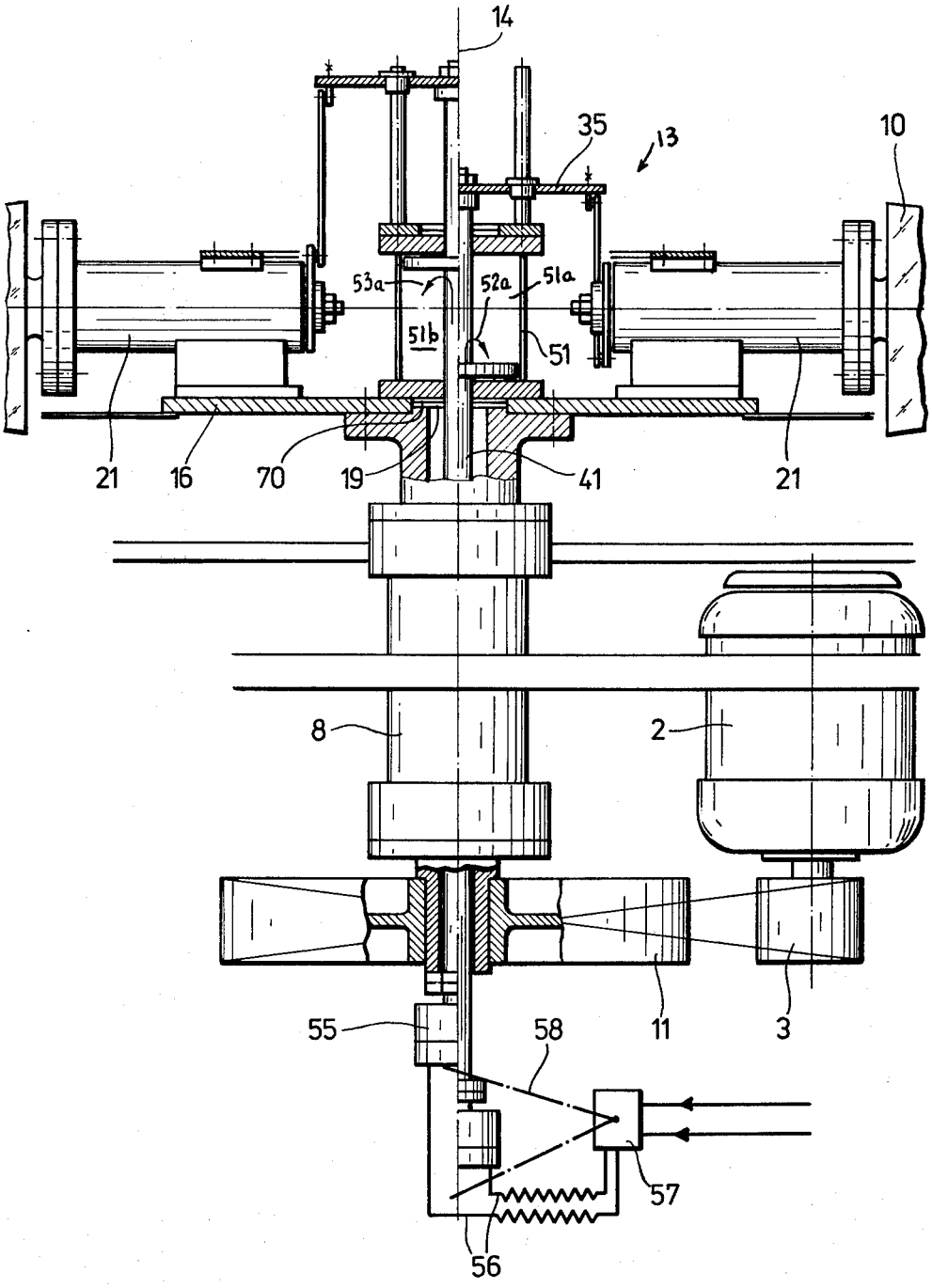
FIG. 6 is a fragmentary sectional view similar to that of FIG. 4 but showing a portion of a third axial flow fan.

The fan a portion of which is shown in FIG. 6 constitutes a modification of the fan shown in FIG. 5. The main difference is that the double-acting cylinder 51 is mounted on the base 16 and replaces the sleeve 42 of the fan 1. In all other aspects, the hub 13 is identical with that shown in FIGS. 1 to 4. The lower end wall of the cylinder 51 has a centering portion 70 which extends into the circular central opening 19 of the base 16 without any or with minimal clearance. The just mentioned lower end wall is bolted, screwed or otherwise affixed to and thus rotates with the base 16.

The pusher 41 has a bore and a pipe (such as the bore 52 and pipe 53 of FIG. 4) extending all the way into the interior of the cylinder 51 and communicating with ports 52*a*, 53*a* to respectively admit pressurized fluid into the upper chamber 51*a* or lower chamber 51*b* of the cylinder 51. Of course, the port 53*a* is free to allow evacuation of fluid from the chamber 51*b* into a suitable reservoir or into the atmoshpere when the port 52*a* admts pressurized fluid to the chamber 51*a,* and vice versa.

It will be seen that the fluid-operated parts of the adjusting mechanism for the blades 10 shown in FIG. 6 are disposed at both sides of the base 16. The construction and operation of the control device 57 and connector 55 are preferably identical with those of the similarly referenced parts in FIG. 4. The right-hand portion of FIG. 6 shows certain parts of adjusting mechanism in positions they assume when the corresponding blade 10 has been moved to one end position (minimum displacement of air), and the right-hand portion shows the parts of the mechanism in positions they assume when the corresponding blade is held in the other end position (maximum displacement of air in response to rotation of the hub 13).

The end walls of the cylinder 51 have centrally located bores for the pusher 41. The surfaces surrounding such bores have grooves for O-rings or other suitable sealing elements.

In each embodiment of the improved axial flow fan, the adjusting mechanism for the blades can be designed in such a way that the pusher need not abut against a stop or arresting means (i.e., the nut 61 shown in FIG. 4 need not abut against the upper portion 55*a* of the connector 55) when the blades 10 assume the corresponding end positions. This is desirable because the pusher is then not subjected to tensional stresses in the corresponding end position of the piston 54. The pusher will be subjected to tensional stresses if the fluid-operated portion of the adjusting mechanism is out of commission; the magnitude of such stresses corresponds to the spare power of the cylinder. The pusher 41 of FIGS. 1–4 and 6 must be dimensioned and its material selected in such a way that it can readily withstand the just discussed tensional stresses in spite of the fact tht a relatively small (FIG. 4) or a substantial (FIG. 6) portion thereof must be made hollow (due to the provision of bore 52 whose diameter must be large enough to receive the pipe 53 with requiste clearance to allow fluid to flow from or to the port 52*a* or 53*a*).

The control device 57 can be replaced by any other suitable control device, e.g., by a system of hydraulic or pneumatic valves which can regulate the flow of pressurized fluid into and the flow of spent fluid from the chambers 51*a,* 51*b* of the cylinder 51 with a degree of accuracy which is necessary to enable the turning means 9 to move the blades 10 to any one of a large or infinite number of different angular positions.

Without further analysis, the foregoing will so fully reveal the gist of the present invention that others can by applying current knowledge, readily adapt it for various applications without omitting features which fairly consititute essential characteristics of the generic and specific aspects of our contribution to the art and, thereforre, such adaptations should and are intended to be comprehended within the meaning and range of equivalence of the claims.

What is claimed as new and desired to be protected by Letters Patent is set forth in the appended claims:

1. In an axil flow fan, a combination comprising a hub rotatable about a first axis and including a substantailly circular plate-like base having a substantially smooth and flat side normal to said axis; means for rotating said base; a plurality of hollow housings affixed to said base at said side thereof and each having a second axis normal to said first axis; a plurality of blades, one for each of said housings, each of said blades having a shank journalled in the respective housing and being turnable about the respective second axis; and means for turning said shanks, including an elongated pusher having an axis coinciding with said first axis and extending through said base, means for moving said pusher axially, displacing means affixed to said pusher at said side of and being rotatable with said base, a lever rigid with each of said shanks, and a discrete power train connecting each of said levers with said displacing means so that axial movements of said pusher in first and second directions respectively result in clockwise and counterclockwise angular displacements of said shanks, including a linkage disposed in a plane which is parallel to said first axis, and including a first double link articulately connected with the respective lever, a second double link articulately connected with said displacing means, and a second lever having a first arm articulately connected with the respective housing, a second arm articulately connected with said respective second double link and an intermediate portion articulately connected with the respective first double link.

2. A combination as defined in claim 1, further comprising bearing means installedd in each of said housings for the respective shanks, each of said shanks being held in the respective housing against movement in the direction of the respective second axis and each thereof having a first end portion remote from said first axis and connected to the respective blade and a second end portion nearer to said first axis and connected with the respective lever, said housings being equally spaced from each other, as considered in the circumferential direction of said base.

3. A combination as defined in claim 1, wherein said base has a second substantially flat and smooth side parallel to said first mentioned side, said means for rotating said base being disposed at said second side.

4. A combination as defined in claim 1, further comprising guide means for said displacing means, said guide means being mounted on said hub and said displacing means being movable along said guide means in the direction of said first axis.

5. A combination as defined in claim 4, wherein said displacing means comprises a disk parallel to said base and having a surface facing said side of said base and provided with reinforcing means.

6. A combination as defined in claim 4, wherein said hub further comprises a sleeve rigid with and disposed at said side of said base, said guide means comprising at least one tie rod rigid with said sleeve and parallel to said pusher, and a follower connected with said displacing means and movable along said tie rod.

7. A combination as defined in claim 6, wherein said guide means comprises two tie rods disposed substantially diameterically opposite each other with respect to said first axis, and two sleeve-like followers each mounted in said displacing means and each slidably surrounding one of said tie rods.

8. A combination as defined in claim 6, wherein said follower is adjustably mounted in said displacing means.

9. A combination as defined in claim 4, wherein said hub further comprises a sleeve disposed at said side of said base and said guide means is mounted on said sleeve, said base having a centrally located opening and said sleeve having a centering projection extending into said opening, and further comprising means for securing said sleeve to said base.

10. A combination as defined in claim 1, wherein said means for moving said pusher axially comprises a fluid-operated motor having a double-acting cylinder and a piston connected with said pusher.

11. A combination as defined in claim 10, wherein said cylinder is coaxial and rigid with and adjacent to said one side of said base.

12. A combination as defined in claim 10, wherein said cylinder has two end walls having openings for said pusher.

13. A combination as defined in claim 10, wherein said base has a second side opposite said first mentioned side, said means for rotating said hub being adjacent to said second side of said base and including a hollow drive shaft surrounding a portion of said pusher and being affixed to said base.

14. A combination as defined in claim 10, further comprising a source of pressurized fluid, said cylinder having first and second chambers at the opposite sides of said piston and said pusher having first and second longitudinally extending channels for respectively connecting said source with said first and second chambers.

15. A combination as defined in claim 14, wherein said pusher further comprises a first port connecting said first channel with said first chamber and a second port connecting said second channel with said second chamber.

16. A combination as defined in claim 14, wherein said pusher has an axially extending bore a pipe mounted with clearance in said bore, said first channel surrounding said pipe and said second channel being surrounded by said pipe.

17. A combination as defined in claim 10, wherein said cylinder has first and second chambers disposed at the opposite sides of said piston, said means for moving said pusher axially further comprising a source of pressurized working fluid, conduit means connecting said source with said chambers, and fluid flow control means in said conduit means.

18. A combination as defined in claim 17, wherein said means for turning said shanks further comprises means for limiting the extent of axial movement of said pusher.

19. A combination as defined in claim 18, wherein said conduit means comprises a connector coaxial with said pusher and having a rotary first portion rigid with said pusher and a non-rotatable second portion, said control means being installed in said conduit means intermediate said second portion of said connector and said source.

20. A combination as defined in claim 1, wherein said hub further comprises a sleeve disposed at said side of said base, said sleeve comprising two concentric spaced-apart ring-shaped members one of which is secured to said base and a plurality of distancing members disposed between and secured to said ring-shaped members, said pusher extending through said sleeve and further comprising guide means for said displacing means, said guide means being mounted on said sleeve.

21. A combination as defined in claim 20, wherein said guide means comprises at least one tie rod parallel to said first axis and mounted on the other of said other ring-shaped members.

22. A combination as defined in claim 1 wherein said base has a second side located opposite said first side and said means for rotating said hub is adjacent to said second side of said base, said means for moving said pusher axially comprising a double-acting fluid-operated cylinder coaxial with said hub and a piston reciprocable in said cylinder and connected with said pusher, said means for rotating said hub being disposed between said cylinder and said base.

23. A combination as defined in claim 22, wherein said means for moving said pusher axially further comprises a source of pressurized working fluid and said cylinder has first and second chambers disposed at the opposite sides of said piston, said pusher extending axially through said cylinder and having first and second channels for respectively connecting said source with said first and second chambers.

24. A combination as defined in claim 23, wherein said means for moving said pusher axially further comprises conduit means connecting said channels of said pusher with said source, a control device installed in said conduit means and arranged to regulate the flow of fluid from said source to said channels and to thus determine the axial position of said pusher and said piston, means for determining the maximum extent of axial movement of said pusher, and means associated with said control means and arranged to indicate the axial position of said pusher.

25. A combination as defined in claim 1, wherein said base has a second side opposite said first mentioned side and said means for moving said pusher axially comprises a double-acting cylinder coaxial with said hub and disposed at said second side of said base and a piston reciprocable in said cylinder, and further comprising a hollow casing securing said cylinder to said base, said pusher having a first portion rotatable with said displacing means and extending through said hub and into said casing, a second portion rigid with said piston, and means for connecting said first and second portions of said pusher to each other so that said first portion is rotatable relative to said second portion and said piston but shares all axial movements of said second portion.

26. A combination as defined in claim 25, wherein said pusher extends through and beyond that side of said cylinder which faces away from said casing and further comprising guide means for said pusher, said guide means being mounted on and being adjacent to said side of said cylinder.

27. A combination as defined in claim 26, wherein said guide means comprises at least one device for limiting the extent of axial movement of said pusher.

28. A combination as defined in claim 1, wherein said means for moving said pusher axially comprises a double-acting fluid-operated cylinder coaxial with said hub, a piston reciprocable in said cylinder and connected with said pusher, a source of pressurized working fluid, and control means for regulating the flow or working fluid from said source to said cylinder, said control means being adjustable radially of said first axis.

29. A combination as defined in claim 1, wherein said means for moving said pusher axially comprises a double-acting fluid-operated cylinder coaxial with said hub, a piston reciprocable in said cylinder and connected with said pusher, a source of pressurized working fluid, and control means connecting said cylinder with said source, said control means being adjustable relative to said cylinder about an axis which is normal to and crosses in space with said first axis.

30. A combination as defined in claim 1, wherein said means for moving said pusher axially comprises a double-acting fluid-operated cylinder coaxial with said hub, a piston reciprocable in said cylinder and connected with said pusher, said piston dividing the interior of said cylinder into first and second chambers, a source of pressurized working fluid, conduit means connecting said source with said cylinder and including first and second conduits respectively communicating with said first and second chambers, diaphragm valves mounted in said first and second conduits, and fluid flow control means mounted in said conduit means between said valves and said source.

31. A combination as defined in claim 1, wherein said housings have substantially cylindrical peripheral surfaces and further comprising brackets securing said housings to said side of said base, said brackets being adjacent to the periphery of said base.

32. A combination as defined in claim 31, further comprising a substantially T-shaped reinforcing element secured to each of said housings opposite the respective bracket and a ring-shaped holder secured to said reinforcing elements, said holder being disposed in a plane parallel to said side of said base.

33. A combination as defined in claim 1, further comprising bearing means installed in each of said housings for the respective shanks, each of said bearing means comprising an angular-contact antifriction bearing.

34. A combination as defined in claim 1, further comprising bearing means installed in each of said housings for the respective shanks, each of said bearing means comprising a needle bearing.

35. A combination as defined in claim 1, wherein said second double links are pivotable with respect to said displacing means about axes which are normal to said first axis.

36. A combination as defined in claim 1, wherein the articulate connection between each of said second double links and said displacing means is adjustable relative to said displacing means.

37. A combination as defined in claim 1, further comprising a carrier interposed between each of said shanks and the respective blade and at least one weight mounted on said carrier.

38. A combination as defined in claim 37, wherein said shanks and the respective blades have abutting coaxial flanges which are affixed to each other and each of said carriers is disposed between the respective flanges.

39. A combination as defined in claim 37, wherein each of said weight is adjustably mounted on the respective carrier.

40. A combination as defined in claim 1, wherein each of said levers is separable from the respective shank and each of said power trains is connected to said displacing means and to respective levers with minimal play.

* * * * *